US007748417B2

(12) United States Patent
Arcuri

(10) Patent No.: US 7,748,417 B2
(45) Date of Patent: Jul. 6, 2010

(54) BEER TENDER

(76) Inventor: Julie Arcuri, 791 Bonita Ave., Elk Grove Village, IL (US) 60007

( * ) Notice: Subject to any disclaimer, the term of this patent is extended or adjusted under 35 U.S.C. 154(b) by 0 days.

(21) Appl. No.: 12/075,439

(22) Filed: Mar. 12, 2008

(65) Prior Publication Data

US 2009/0229699 A1 Sep. 17, 2009

(51) Int. Cl.
*B65B 1/30* (2006.01)

(52) U.S. Cl. ..... 141/198; 141/83; 141/192; 141/271

(58) Field of Classification Search ..... 141/2, 141/83, 95, 192, 198, 271, 272
See application file for complete search history.

(56) References Cited

U.S. PATENT DOCUMENTS 3,370,750 A * 2/1968 Deatch ..... 222/30
4,138,092 A * 2/1979 Apellaniz ..... 251/325
4,738,285 A * 4/1988 Belland ..... 141/1
5,086,817 A * 2/1992 Murphy ..... 141/271

* cited by examiner

*Primary Examiner*—Timothy L Maust
(74) *Attorney, Agent, or Firm*—Lester N. Arnold

(57) ABSTRACT

An improved beer tender apparatus for hands-free drawing of beer, including an improved main pitcher support assembly having pivoting parallel support bar means depending from a base means and connected on one end to pivot about a pivot axis, pitcher support means connected to the other end of the pivoting support bars means, suitable to support an empty pitcher in an upright angularly tilted position, improved biasing means connected between the base means and the pitcher support means, biasing the pitcher support means into a first angular tilted position, and being responsive to the increasing weight of the pitcher to move the pitcher support means to an upright position, and to again assume the first angular titled position when the filled beer pitcher is removed.

4 Claims, 2 Drawing Sheets

BEER TENDER

FIELD OF THE INVENTION

This invention relates to multi tasking devices. More specifically this invention relates to a hands free dispensing system that is configured for a pitcher to be placed on and placed under beer taps to allow for hands free, consistent transfer of beer from the tap into plastic or glass serving pitchers, and more particularly, allow for the increasing weight of the pitcher to slowly change from a tilted pitcher angle into an upright position.

BACKGROUND OF INVENTION

Currently in large part the art or practice of transferring beer into a pitcher is performed by hand. Beer must be transferred by hand in a controlled manner in which a person must physically hold a pitcher and tip a pitcher from an angle to an upright position to allow an accurate proportion of beer and foam mixture. The manual practice of beer tapping requires hands on, manual operation which is time consuming.

A need has arisen for this improved beer dispensing apparatus in accordance with this invention that will allow a hands free operation to place a pitcher so that the improved apparatus of this invention will allow a person to multi task as the improved beer pitcher support assembly of a beer dispensing system is being used.

DESCRIPTION OF PRIOR ART

The current art of tapping beer to this day requires a hands-on, manual operation, which does not allow for one to leave the function in progress until the pitcher is full. A person must stand at the beer tap and manually move the angle of the pitcher to allow for the required beer/foam mix. It takes approximately 30 seconds to pour a pitcher of beer. A person can perform several tasks in that times if hands free system were in place.

A need has arisen for this invention that will allow a hands free operation so a person may multi task while the beer transfer function is being performed.

SUMMARY OF INVENTION

This invention providing an improved beer pitcher support assembly is directed to provide an improved apparatus for hands free dispensing of beer into pitcher container means that can be placed under a beer tapping system, and allow for a hands free operation to transfer dispensed beer flowing in a beer stream into a pitcher. In addition, the improved apparatus of this invention may be moved to various locations. The improved beer pitcher support assembly of this invention includes a main pitcher support assembly that is attached to pivoting support bars or arm means. The support bars are pivotal, and designed to connect to a motion control device that allow for the pitcher angle to change from a tilted position to upright position as the weight of the pitcher increases. Both the main support assembly and pivoting support arms are connected to a solid base.

The improved apparatus of this invention begins at a tilted angle, as weight of the pitcher increases, the pivoting arms connected with the motion control assembly allows the beer to flow into the pitcher at a tilted position or angle and slowly move the pitcher to any upright vertical position.

FIG. 1 is a perspective isometric view of the improved main pitcher support assembly of the current invention shown in an upright position and; FIG. 2 is a perspective isometric view of the improved apparatus of the invention in its ending upright position.

Referring now to FIG. 1 there is shown the improved apparatus embodying the present invention in the tilted, starting or first angular position. As hereinafter described the pitcher support assembly is movable from its tilted starting position, to an upright vertical position of FIG. 2. The improved apparatus of the invention disclosed herein in accordance with the preferred embodiment, includes a main base 10, a right support bar 14, a left support bar 16, which are spaced apart in parallel alignment to each other in the preferred embodiment and define free-end portions thereof disposed distal from the pivot axis connection thereof, a main support bar 20, and a pitcher container locator 18 provided on a selected one of the right or left support bars 14 or 16, as shown in FIG. 1, to support and provide the location of a pitcher or container means (shown in the drawings in phantom). A pitcher is place onto a pitcher support seat member or means 12 when the improved apparatus of this invention is in the initial, tilted or first angular position removed outwardly from the main base 10, as shown in FIG. 1. The support bar 14, the parallel spaced support bar 16, and the pitcher locator 18, may be mounted so as to pivot about a main pivot axis provided by a bearing housing 40 and pivoting housing 48 mounted to the main base 10, pivoting support assembly 12, 14, 16, 18 40, 46, 48 and 50 providing the mechanical pivoting assembly for pitcher tilting movement capability.

The pivoting support assembly 12, 14, 16, 18, 40, 46, 48 and 50 are mounted to the main support bar or means 20.

Motion transfer of the pivoting support assembly is provided by the linear motion, re-circulated ball bearing guide block and a rail and adjustable present force gas spring 30, which comprises a motion control device or means or assembly to provide a motion control biasing means or spring means preset to hold the support assembly outwardly of the main base 10, in its default position, at a first preselected angular tilted position, and to gradually reduce the bias of the gas spring means 30 in response to increasing weight of the beer holding or loaded pitcher container means (shown in phantom in the drawings) to cause the pivoting support bar means 14, 16 and 20, from the default position to a second vertical upright position with respect to the solid base means 10, when the pitcher means is substantially filled with beer. A force direction bar 34 may be attached to the linear motion re-circulated ball bearing guide block and rail and pivoting support system assembly 12, 14, 16, 18, 40, 46, 48, and 50.

Adjustable, preset force gas spring 30 is attached to the re-circulating ball bearing guide block and rail 36 at attachment bolt 24 and main support attachment bolt 22.

Increasing weight of the pitcher as increasing quantity of beer is added, forces the pivoting support assembly 12, 14, 16, 18, 40, 46, 48, and 50 downward applying force on the force direction bar 34.

The force direction bar 34 forces the motion control assembly, linear motion, re-circulation ball bearing guide block and rail 36 upward.

The upward motion of the force direction bar 34 causes the force gas spring 30 to compress as liquid fills the pitcher.

When the pitcher is full and force is released from the pivoting support assembly 12, 14, 16, 18, 40, 46, 48, and 50 the force gas spring 30 returns to its home position as shown in FIG. 1, ready for reuse.

Height of the disclosure maybe adjusted by using 4 thumbscrews 52, 54, 56, 58 located at the bottom of base 10.

Since certain changes may be made in the foregoing preferred embodiment of the invention disclosed herein without departing from the scope of the invention, it is intended that all matter contained in the above description and depicted in accompanying drawings be construed in an illustrative and not limiting sense including enhancement by possible adding a sensor arm to include, but not limited to programmable control logic, optical sensors, timer, on/off switches, relays, motorized motion control or hybrid systems.

DETAILED DESCRIPTION OF THE PREFERRED EMBODIMENT

Figure 1:
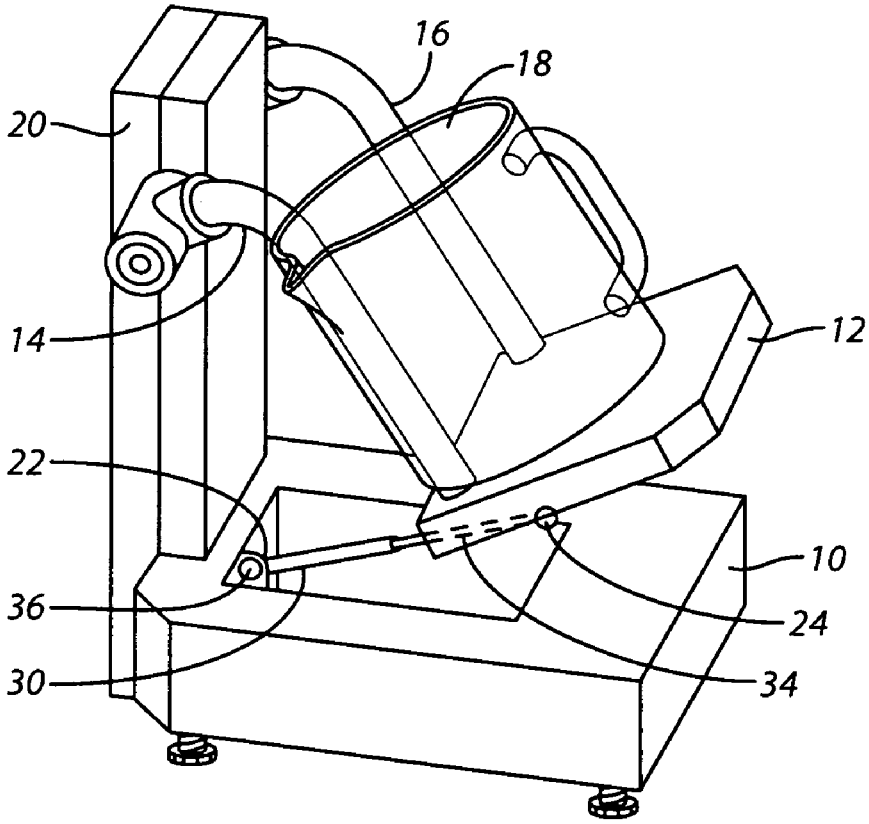
FIG. 1 is a perspective isometric view of this invention in its upright position.
Figure 2:
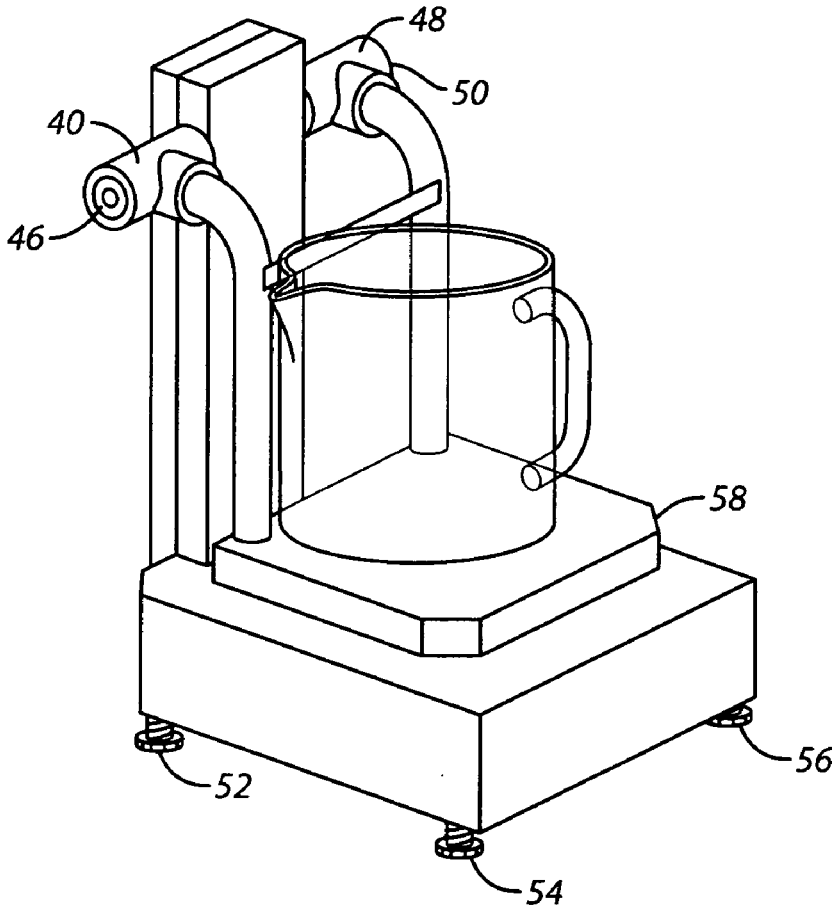
FIG. 2 is a perspective isometric view of this invention in its ending, used position.

For a more complete understanding of the improved apparatus comprising the invention, reference should be made to the following detailed description on accompanied drawings where:

FIG. 1 is a perspective isometric view of the improved apparatus comprising the invention herein termed as a Beer Tender device or apparatus, in its upright vertical position and; FIG. 2 is a perspective isometric view of the BeerTender in its ending position. Referring now to FIG. 1 there is a shown the BeerTender device embodying the present invention in the tilted, starting or default position. As herein after described the pitcher support assembly is movable from its tilted position to an upright position FIG. 2.

The improved apparatus of this invention may in its preferred embodiment include a main base 10, a support right bar 14, a left support bar 16, a main support bar 20, and a pitcher locator 18, to support and location of a pitcher.

A pitcher is placed onto a pitcher support seat 12 when the disclosure is in the initial, tilted position shown in FIG. 1. The support bar 14, the support bar 16, and the pitcher locator 18 may be mounted to pivoting a bearing housing 40 and pivoting housing 48, pivoting support assembly 12, 14, 16, 18, 40, 46, 48, and 50 providing the mechanical pivoting or pitcher tilting capability.

The pivoting support assembly 12, 14, 16, 18, 40, 46, 48, and 50 are mounted to the main support 20.

Motion transfer of the pivoting support assembly 12, 14, 16, 18, 40, 46, 48, and 50 is controlled and regulated by the linear motion, re-circulated ball bearing guide block and a rail and adjustable preset force gas spring 30. A force direction bar 34 may be attached to the linear motion re-circulated ball bearing guide block and rail and pivoting support system assembly 12, 14, 16, 18, 40, 46, 48, and 50.

Adjustable, preset force gas spring 30 is attached to the re-circulating ball bearing guide block and rail 36 at attachment bolt 24 and main support attachment bolt 22.

Increasing weight of the pitcher as increasing quantity of beer is added, forces the pivoting support assembly 12, 14, 16, 18, 40, 46, 48, and 50 downward applying force on the force direction bar 34.

The force direction bar 34 forces the motion control assembly, linear motion, re-circulation ball bearing guide block and rail 36 upward.

The upward motion of the force direction bar 34 causes the force gas spring 30 to compress as liquid fills the pitcher.

When the pitcher is full and force is released from the pivoting support assembly 12, 14, 16, 18, 40, 46, 48, and 50 the force gas spring 30 returns to its home position as shown in FIG. 1, ready for reuse.

Since certain changes may be made in the forgoing disclosure without departing from the scope of the invention, it is intended that all matter contained in the above description and depicted in accompanying drawings be construed in an illustrative and not limiting sense including enhancement by possible adding a sensor arm to include, but not limited to programmable control logic, optical sensors, timer, on/off switches, relays, motorized motion control or hybrid systems.

What is claimed is:

1. An improved beer dispensing apparatus for hands free dispensing of beer into pitcher container means, including solid base means providing a vertical position, main pitcher support assembly means including pivoting support bar means connected to the solid base means along a pivot axis and providing pivoting movement about the pivot axis, and including a distal free-end portion thereof removed from connection to the pivot axis, and including pitcher support member connected to the free-end portion of the support bar means and biased to extend outwardly therefrom in a direction angularly removed from the vertical position of the solid base means, and supporting thereon pitcher means in multiple correspondingly angularly removed positions, and motion control means selectively connected to the pitcher support member and biasing the pitcher support member to at least a first angular tilted position of preselected tilt to the vertical position of the solid base means, whereby the pitcher means is supported in a tilted position to receive a beer stream, and the motion control means providing less bias in response to increasing weight of the beer holding pitcher means to cause the pivoting support bar means and the connected pitcher support means to move toward the solid base means to a second position of vertical upright orientation with respect to the solid base means when the pitcher means is substantially filled with beer.

2. The improved apparatus of claim 1 wherein the pivot support bar means are comprised of a pair of parallel spaced apart arm members against which the pitcher means is partially supported during angular displacement from the vertical position, and during biased movement of the pitcher support member provided by the motion control means.

3. The improved apparatus of claim 1 wherein the first angular tilted position of the pitcher support member provides for the flow of the beer stream being dispensed into the pitcher to strike a side wall of the pitcher means to provide for proportionate beer and foam mixture.

4. The improved apparatus of claim 1 wherein the solid base means is movable for being positioning beneath a beer tap of a beer dispensing system having multiple beer tapping positions.

* * * * *